US007607605B2

(12) United States Patent
Behmel

(10) Patent No.: US 7,607,605 B2
(45) Date of Patent: Oct. 27, 2009

(54) APPARATUS AND METHOD FOR REVERSING A PRINT MATERIAL WEB

(75) Inventor: Johannes Behmel, Plauen (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 48 days.

(21) Appl. No.: 11/925,441

(22) Filed: Oct. 26, 2007

(65) Prior Publication Data

US 2008/0128978 A1 Jun. 5, 2008

(30) Foreign Application Priority Data

Oct. 28, 2006 (DE) ..... 10 2006 050 910

(51) Int. Cl.
*B65H 23/04* (2006.01)

(52) U.S. Cl. ..... 242/615.2; 242/615.21

(58) Field of Classification Search ..... 242/615.1, 242/615.11, 615.12, 615.2, 615.21
See application file for complete search history.

(56) References Cited

U.S. PATENT DOCUMENTS

| | | | | |
|---|---|---|---|---|
| 5,100,117 | A * | 3/1992 | Hajek et al. | 270/52.08 |
| 5,464,143 | A | 11/1995 | Hansen | |
| 5,520,317 | A * | 5/1996 | Eckert et al. | 242/615.12 |
| 7,073,747 | B2 * | 7/2006 | Weis | 242/615.1 |
| 7,100,864 | B2 * | 9/2006 | Weis | 242/615.12 |
| 7,275,709 | B2 * | 10/2007 | Weis | 242/615.12 |
| 2004/0149855 | A1 * | 8/2004 | Weis | 242/615.21 |

FOREIGN PATENT DOCUMENTS

| | | | |
|---|---|---|---|
| DE | 3215472 | A1 | 11/1983 |
| DE | 3436870 | C1 | 5/1986 |
| DE | 41 17 094 | A1 | 12/1992 |
| DE | 43 11 438 | A1 | 10/1994 |
| DE | 101 12 416 | C1 | 10/2002 |
| DE | 101 31 272 | A1 | 1/2003 |
| DE | 101 37 725 | A1 | 2/2003 |
| EP | 0 582 927 | A1 | 2/1994 |

* cited by examiner

*Primary Examiner*—Sang Kim
(74) *Attorney, Agent, or Firm*—Crowell & Moring LLP

(57) ABSTRACT

An apparatus and method for reversing a print material web is disclosed. A reversing bar unit includes a frame and a reversing bar pivotably mounted on the frame at a pivot point. The reversing bar includes an outer tube and an inner tube. A first end of the coupling element is coupled to the inner tube and a second end of the coupling element is moveably coupled to the frame at a distance from the pivot point. Upon a pivoting of the reversing bar the coupling element translationally or rotationally moves the inner tube relative to the outer tube.

8 Claims, 4 Drawing Sheets

APPARATUS AND METHOD FOR REVERSING A PRINT MATERIAL WEB

This application claims the priority of German Patent Document No. 10 2006 050 910.2, filed Oct. 28, 2006, the disclosure of which is expressly incorporated by reference herein.

BACKGROUND AND SUMMARY OF THE INVENTION

The invention relates to an apparatus and method for reversing a print material web.

With a reversing device of a reel-fed rotary printing machine designed as a reversing bar unit, printed print material webs, which are fed to the reversing bar unit from two different directions, can be removed from the reversing bar unit in a common direction in order to feed the print material webs to a single further processing unit arranged downstream of the reversing bar unit. Likewise, print material webs which are fed to the reversing bar unit from a common direction can be deflected with the help of a reversing bar unit such that the print material webs leave the reversing bar unit in a different direction in order to feed the print material webs to different further processing units arranged downstream of the reversing bar unit. A reversing device has a frame and at least one reversing bar pivoted on the frame, wherein the, or each, reversing bar can be pivoted between two pivot positions or working positions. Depending on the pivot position or working position of a reversing bar a deflection of a print material web in different direction occurs, wherein depending on the pivot position of a reversing bar a print material web wraps the reversing bar on different sides.

From German Patent Document DE 101 31 272 B4 a reversing device with at least one pivoted reversing bar is known, wherein on the pivoted reversing bar transport of the print material webs is facilitated via an air cushion between the reversing bar and the print material web.

To this end, the reversing bar of DE 101 31 272 B4 has a jacket provided with holes. The jacket provided with holes of the reversing bar is also called an outer tube. In the outer tube of the reversing bar a closing body is arranged which is also called an inner tube, wherein the closing body or the inner tube exposes a group of holes of the outer tube or jacket depending on the pivot position of the pivotable reversing bar and closes another group of holes of the outer tube or jacket.

According DE 101 31 272 B4 the closing body or the inner tube performs a rotation about preferably 1800 during pivoting of the reversing bar from one pivot position or working position to the other pivot position or working position so that the group of holes which is exposed in a pivot position of the reversing bar is closed in the other pivot position. Here, the rotation of the closing body or inner tube is coupled to the adjustment of the reversing bar, wherein a stationary ring gear serves for this purpose, which ring gear meshes with an outer toothing associated with the closing body or the inner tube. Such a coupling via intermeshing toothings is relatively complex in terms of design.

Taking this as a starting point the present invention is based on the problem of creating a new type of reversing device with a simpler design structure. According to the invention the outer tube is pivoted on the frame wherein a mechanical coupling element with a first end acts on the inner tube and with a second end is moveably mounted on the frame, wherein a bearing point of the mechanical coupling element on the frame associated with the second end is spaced from a pivot axis of the outer tube and wherein the mechanical coupling element upon pivoting of the outer tube and thus the inner tube simultaneously brings about a translatoric, or translational, adjustment or a rotatoric, or rotational, adjustment of the inner tube relative to the outer tube.

The reversing bar device according to the invention has a mechanical coupling element which, with a first end, acts on the inner tube of a reversing bar and with a second end is moveably mounted on the frame on which the outer tube of the reversing bar is also mounted in a pivotable manner, wherein a bearing point of the mechanical coupling element on the frame is spaced from a pivot axis of the outer tube. With such a mechanical coupling element upon pivoting of the outer tube and thus the inner tube a translatoric or a rotatoric adjustment of the inner tube relative to the outer tube can be simultaneously brought about. The reversing device according to the invention has a relatively simple design structure.

According to a first advantageous further development of the invention the mechanical coupling element is moveably mounted with the first end on the inner tube, wherein the coupling element upon pivoting of the outer tube and the inner tube simultaneously brings about a translatoric adjustment of the inner tube relative to the outer tube.

According to a second advantageous further development of the invention the mechanical coupling element with the first end acts on the inner tube in a fixed manner, wherein the coupling element upon pivoting of the outer tube and the inner tube simultaneously brings about a rotatoric adjustment of the inner tube relative to the outer tube.

A preferred use of the reversing device according to the invention consists in repositioning the print material web strands at different levels.

Preferred further developments of the invention are obtained from the following description. Exemplary embodiments of the invention are explained in more detail by the drawings without being restricted to these.

DETAILED DESCRIPTION OF THE DRAWINGS

Figure 1:
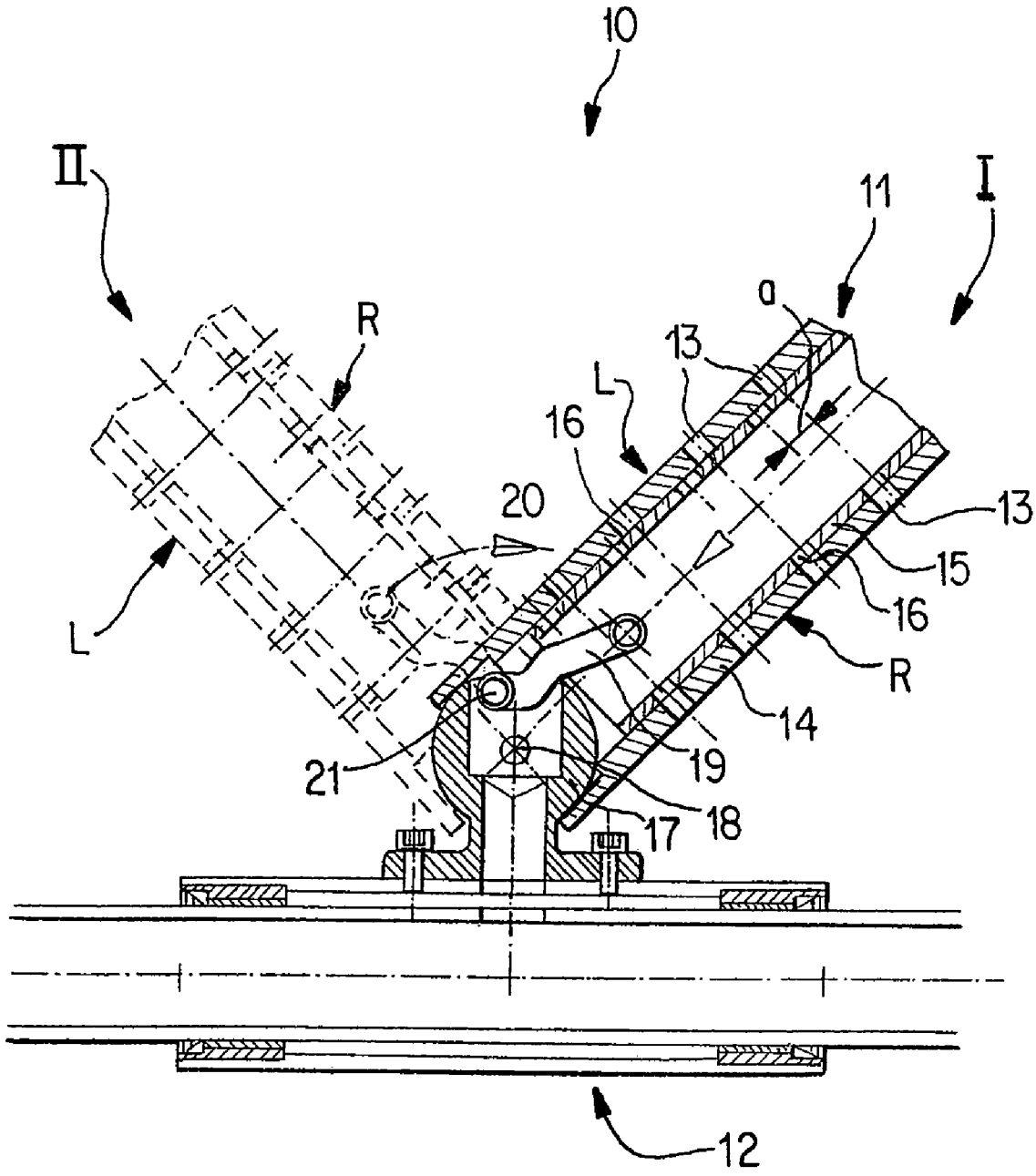
FIG. 1 is a cut-out cross section through a reversing device according to the invention according to a first exemplary embodiment of the invention in a first position.
Figure 2:
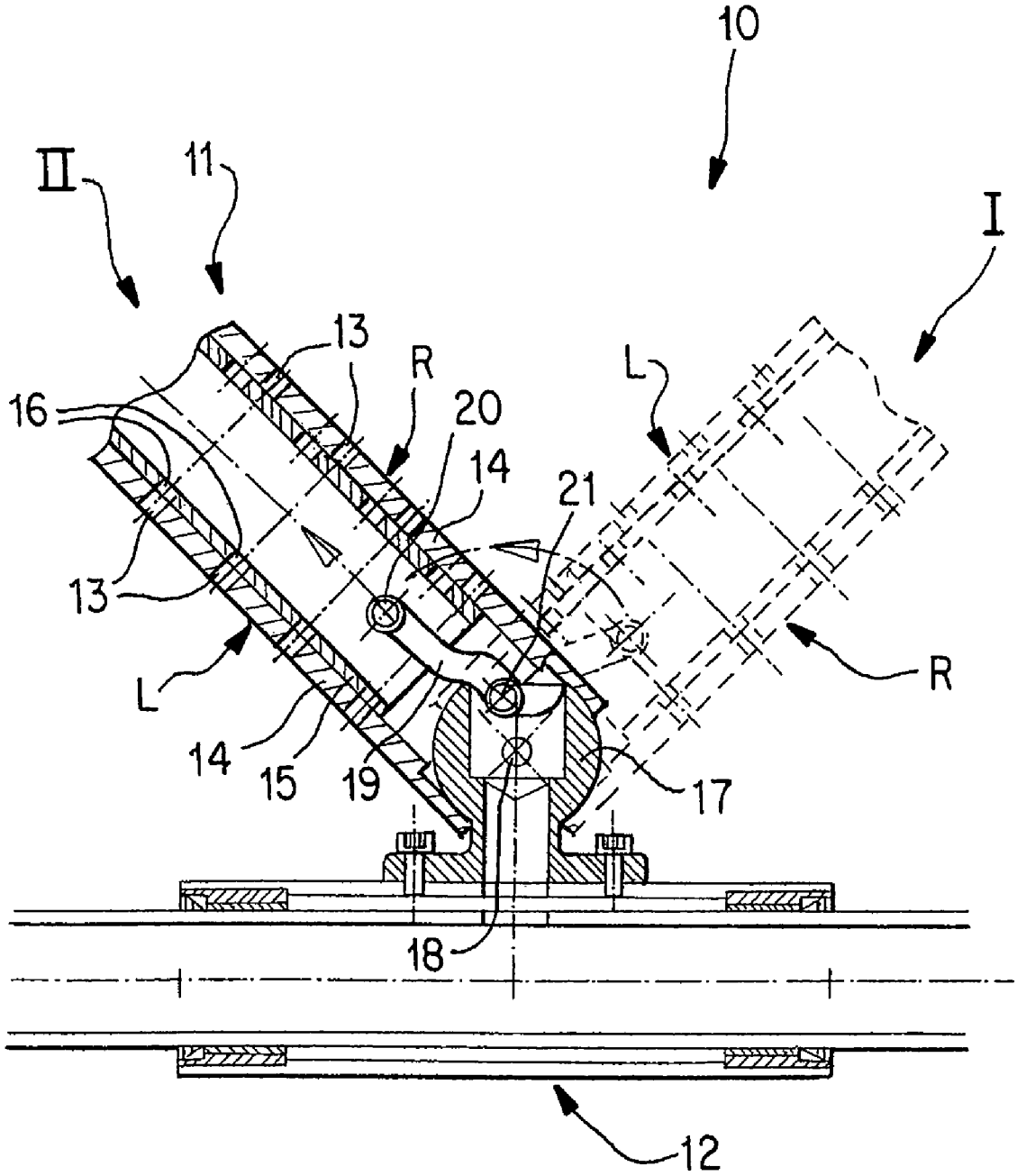
FIG. 2 shows the reversing device of FIG. 1 in a second position.

FIGS. 1 and 2 show a cut-out cross section through a reversing device 10 according to the invention in the region of a pivotable reversing bar 11, wherein FIGS. 1 and 2 show the reversing bar 11 in different pivot positions each, namely in a pivot position shown in a continuous line and in a pivot position shown in a dashed line.

The reversing bar unit 10 according to the invention has a frame 12 and at least one reversing bar 11 mounted on the frame 12 in a pivotable manner. The reversing bar 11 can be mounted on one side or both sides on the frame 12, wherein in FIG. 1 merely one side or one end of the reversing bar 11 is visible.

The reversing bar 11 shown in FIG. 1 has an outer tube 14 provided with recesses 13, wherein in the outer tube 14 an inner tube 15 is arranged which likewise has recesses 16. In a first pivot position I of the reversing bar 11 a group of recesses 13 is congruent with a group of recesses 16 arranged on the right side R of the inner tube 15 so that the recesses 16 of the inner tube 15 expose the recesses 13 of the outer tube 14. In this first pivot position I however a group of recesses 13 of the outer tube 14 positioned on the left side L is offset to the corresponding recesses 16 of the inner tube so that the recesses 13 of the outer tube 14 are closed by the inner tube 15.

If the reversing bar 11 is transferred from the pivot position I shown in the continuous line in FIG. 1 to the pivot position II shown in the continuous line in FIG. 2, the inner tube 15 exposes the group of recesses 13 of the outer tube 14 arranged on the left side L, while the group of recesses 13 arranged on the right side R is blocked or closed by the inner tube 15.

According to FIGS. 1 and 2 the reversing bar 11 and the outer tube 14 of the reversing bar are mounted in a pivotable manner on a section 17 of the frame 12, wherein upon transfer of the reversing bar 11 between the pivot positions I and II the outer tube 14 is pivotable about a pivot axis 18, which extends through the section 17 of the frame 12. On pivoting of the outer tube 14 about the pivot axis 18 the inner tube 15 is simultaneously pivoted as well, while in the exemplary embodiment of FIG. 1 the inner tube 15 is simultaneously adjusted or displaced in a translatoric manner relative to the outer tube 14.

To provide this translatoric displacement of the inner tube 15 relative to the outer tube 14 of the reversing bar 11 which overlies the pivot movement, a mechanical coupling element 19 with a first end 20 and with a second end 21 acts in an articulated manner with a first end 20 on the inner tube 15 and with a second end 21 on the section 17 of the frame 12. Accordingly, the mechanical coupling element 19 on the one hand is moveably mounted on the inner tube 15 of the reversing bar and on the other hand on the section 17 of the frame. Here, according to FIGS. 1 and 2 a bearing point of the mechanical coupling element 19 associated with the second end 21 on section 17 of the frame 12 is spaced from the pivot axis 18 of the outer tube 14 so that the mechanical coupling element 19 provides a type of coupling gear. On transferring the reversing bar 11 between the two pivot positions I and II a distance between the pivot axis 18 and a bearing point on the inner tube 15 associated with the first end 20 of the mechanical coupling element 19 is either increased or reduced, which ultimately causes the translatoric displacement of the inner tube 15 relative to the outer tube 14 of the reversing bar 11 which overlies the pivot movement.

The dimension of the translatoric displacement of the inner tube 15 relative to the outer tube 14 upon pivoting of the reversing bar 11 and thus the inner tube 15 as well as the outer tube 14 is visualized in FIG. 1 through the dimension a, wherein the recesses 16 of the inner tube 15 arranged on the left side L and the right side R are offset by this dimension a relative to one another.

In the exemplary embodiment of FIGS. 1 and 2 the reversing bar 11 is thus mounted about the pivot axis 18 on the frame 12. The outer tube 14 of the reversing bar 11 thus has a group of recesses 13 each on both the right side R and also the left side L through which the compressed air can be routed. The inner tube 15 mounted in the outer tube 14 likewise has recesses 16 on the right side R and on the left side L, wherein the recesses 16 on the right side R of the inner tube 15 are offset in axial direction by the dimension a relative to the recesses 16 on the left side L of the inner tube 15. The inner tube 15 is connected with the frame 12 via the mechanical coupling element 19, wherein the mechanical coupling element 19 is moveably mounted both on the inner tube 15 and on the frame 12.

Here, the bearing point of the coupling element 19 on the frame 12 associated with the end 21 of the coupling element 19 is offset relative to the pivot axis 18 so that upon pivoting of the reversing bar 11 about the pivot axis 18 the inner tube 15 is translatorically or linearly adjusted or displaced by the dimension a relative to the outer tube 14. Depending on this translatoric displacement either the recesses 13 arranged on the left side L of the outer tube 14 or the recesses 13 arranged on the right side R of the outer tube 14 are exposed or closed. In contrast with this it is also possible that the recesses 13 formed on opposite sides L and R of the outer tube 14 are offset relative to one another by this dimension a.

A second exemplary embodiment of a reversing device 22 according to the invention is shown by FIGS. 3 and 4, wherein FIGS. 3 and 4 again show a cut-out cross section through such a reversing device 22 in the region of an end of a reversing bar 11. Since the construction of the reversing device 22 of the exemplary embodiment according to FIGS. 3 and 4 in principle corresponds to the construction of the reversing device 10 of the exemplary embodiment of FIGS. 1 and 2, identical reference numbers are used for identical assemblies in order to avoid unnecessary repetitions while only the details which distinguish the exemplary embodiment of FIGS. 3 and 4 from the exemplary embodiment of FIGS. 1 and 2 are discussed in the following.

Figure 3:
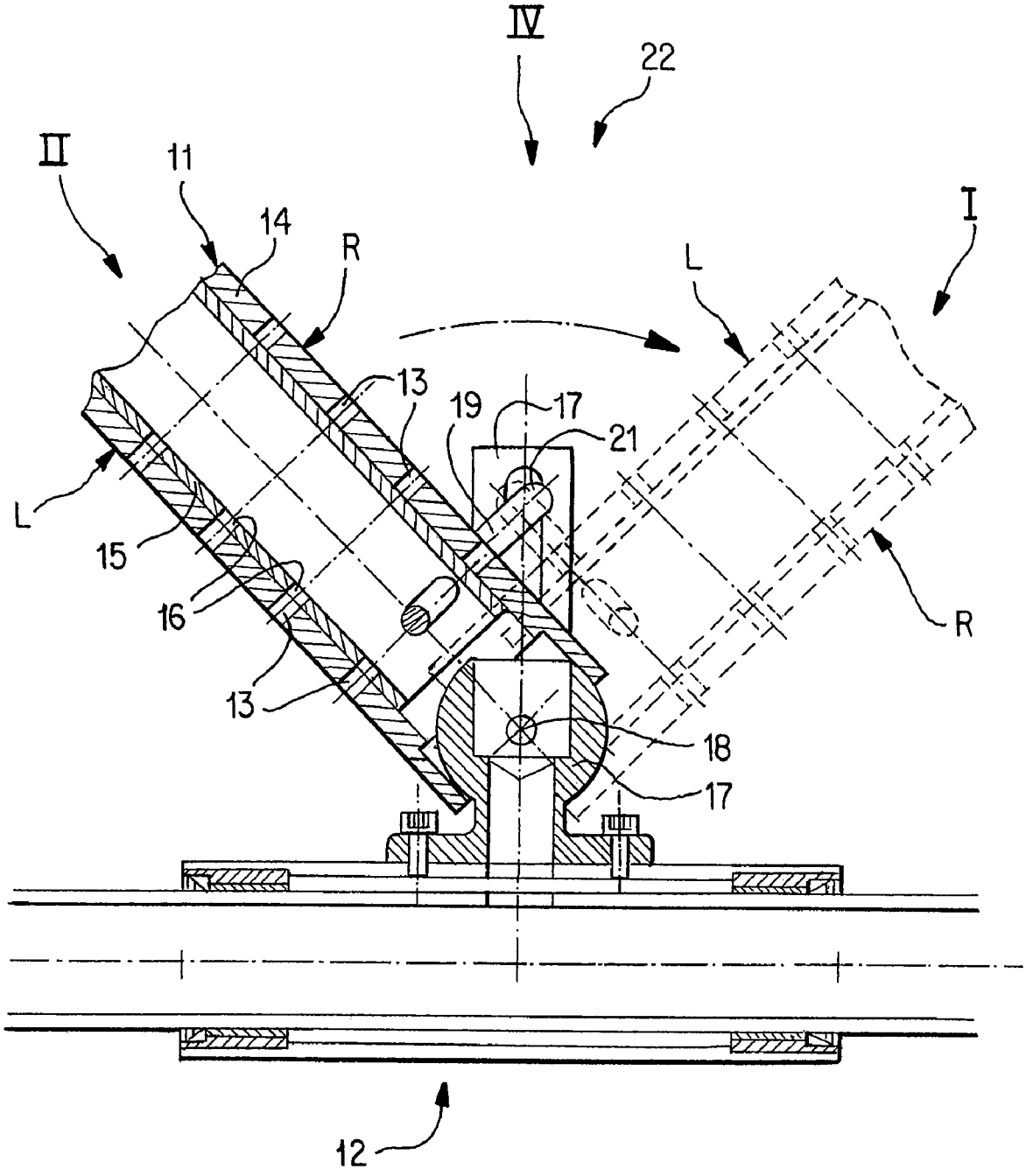
FIG. 3 is a cut-out cross section through a reversing device according to the invention according to a second exemplary embodiment of the invention.
Figure 4:
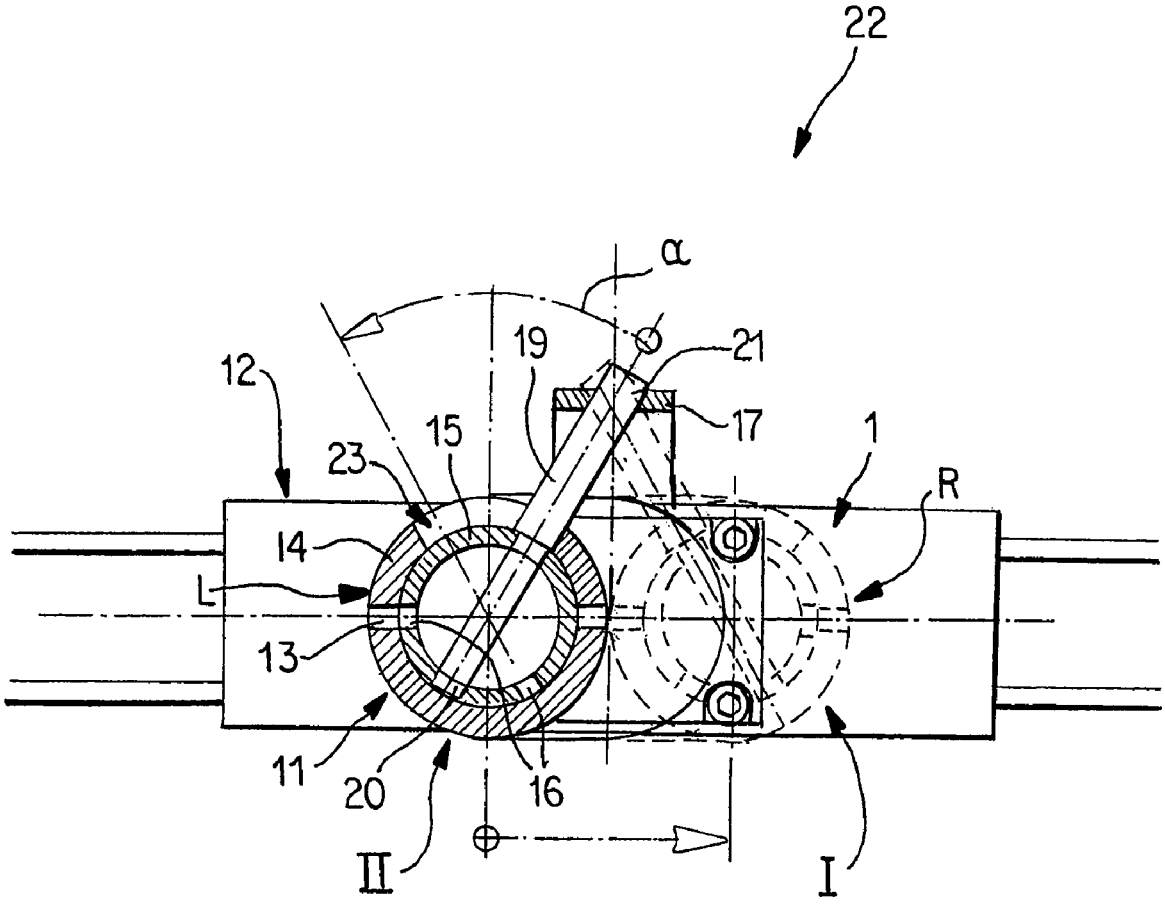
FIG. 4 shows the reversing device of FIG. 3 in viewing direction IV according to FIG. 3.

In the exemplary embodiment of FIGS. 3 and 4 upon pivoting of the reversing bar 11, i.e., of the outer tube 14 and the inner tube 15, the inner tube 15 is rotatorically adjustable, i.e., rotatable relative to the outer tube 14. This is again helped by a mechanical coupling element 19 which with the first end 20 acts on the inner tube 15 and with the second end 21 is moveably mounted on the frame 12. In the exemplary embodiment of FIGS. 3 and 4 the first end 20 of the coupling element 19 acts on the inner tube 15 of the reversing bar in a fixed manner, wherein the coupling element 19 according to FIG. 4 is guided in an elongated hole 23 of the outer tube 14.

Upon pivoting of the reversing bar 11 and thus the outer tube 14 as well as the inner tube 15 about the pivot axis 18 the coupling element 19 is rotated about the bearing point associated with the second end 21 of the coupling element 19, wherein induced by the coupling element 19 acting on the inner tube 15 in a fixed manner with the first end 20, the inner tube 15 is rotated relative to the outer tube 14 by an angle $\alpha$.

The angle $\alpha$ by which the inner tube 15 is rotated relative to the outer tube 14 upon pivoting of the reversing bar 11 is smaller than 90°. In the exemplary embodiment shown this angle $\alpha$ is around 60°.

Recesses 16 provided in the inner tube 15 are also offset by this angle $\alpha$ relative to one another so that in the pivot position II the recesses 13 associated with the left side L of the outer tube 14 are exposed and the recesses 13 associated with the right side R of the outer tube 14 are blocked by the inner tube 15. In the pivot position I however the recesses 13 associated with the left side L of the outer tube 14 are blocked by the inner tube 15 and the recesses 13 associated with the right side R of the outer tube 14 are exposed, wherein, if recesses 13 associated with the outer tube 14 are exposed, these recesses 13 are congruent with a group of recesses 16 associated with the inner tube 15.

In both pivot positions I and II the inner tube 15 covers the elongated hole 23 of the outer tube 14 so that no compressed air can escape via the elongated hole 23 in any pivot position of the reversing bar.

LIST OF REFERENCE NUMBERS

10 Reversing device
11 Reversing bar
12 Frame
13 Recess
14 Outer tube
15 Inner tube
16 Recess
17 Section
18 Axis
19 Coupling element
20 First end
21 Second end
22 Reversing device
23 Elongated hole The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A reversing device, comprising:

a) a frame;

b) a reversing bar pivotably mounted on the frame, wherein the reversing bar includes:

b1) an outer tube on which a material web is guidable and redirectable, wherein the outer tube defines recesses; and b2) an inner tube disposed in the outer tube, wherein the inner tube defines recesses;

b3) wherein the inner tube closes recesses of the outer tube and exposes other recesses of the outer tube depending on a pivot position of the reversing bar, such that:

b31) wherein in a first pivot position of the reversing bar on a first side of the reversing bar, a first group of recesses of the outer tube is congruent with a first group of recesses of the inner tube thereby exposing the first group of recesses of the outer tube, and wherein in the first pivot position of the reversing bar on a second side of the reversing bar, a second group of recesses of the outer tube is offset from a second group of recesses of the inner tube thereby closing the second group of recesses of the outer tube;

b32) wherein in a second pivot position of the reversing bar on the first side of the reversing bar, the first group of recesses of the outer tube is offset from the first group of recesses of the inner tube thereby closing the first group of recesses of the outer tube, and wherein in the second pivot position of the reversing bar on the second side of the reversing bar, the second group of recesses of the outer tube is congruent with the second group of recesses of the inner tube thereby exposing the second group of recesses of the outer tube;

c) wherein upon transferring of the reversing bar from the first pivot position to the second pivot position an adjustment of the inner tube relative to the outer tube is coupled with a pivot movement of the outer tube so that, upon pivoting of the outer tube and the inner tube, the inner tube is simultaneously adjustable in order to close a recess of the outer tube which is open in the first pivot position and in order to open a recess of the outer tube which is closed in the first pivot position;

d) wherein the outer tube is pivotably mounted on the frame;

e) wherein a mechanical coupling element is moveably mounted with a first end of the mechanical coupling element mounted on the inner tube and with a second end of the mechanical coupling element mounted on the frame;

f) wherein the second end of the mechanical coupling element forms a bearing point of the mechanical coupling element on the frame and wherein the bearing point is spaced from a pivot axis of the outer tube so that the mechanical coupling element provides a coupling gear; and g) wherein the mechanical coupling element upon pivoting of the outer tube and the inner tube simultaneously brings about a translational adjustment or a rotational adjustment of the inner tube relative to the outer tube.

2. The reversing device according to claim 1, wherein the mechanical coupling element with the first end is moveably mounted on the inner tube, wherein the coupling element upon pivoting of the outer tube and the inner tube simultaneously brings about a translational adjustment of the inner tube relative to the outer tube.

3. The reversing device according to claim 1, wherein upon pivoting of the reversing bar from the first pivot position to the second pivot position a distance between the first end of the coupling element and the pivot axis is reduced or increased.

4. The reversing device according to claim 1, wherein the recesses are defined on two opposite sides of the outer tube and on two opposite sides of the inner tube and wherein the recesses defined on opposite sides of the inner tube are offset in an axial direction relative to one another by an amount by which the inner tube is translationally adjustable relative to the outer tube during pivoting.

5. The reversing device according to claim 1, wherein the recesses are defined on two opposite sides of the outer tube and on two opposite sides of the inner tube and wherein the recesses defined on opposite sides of the outer tube are offset relative to one another by an amount by which the inner tube is translationally adjustable relative to the outer tube during pivoting.

6. The reversing device according to claim 1, wherein the mechanical coupling element with the first end is connected with the inner tube in a fixed manner, wherein the coupling element upon pivoting of the outer tube and the inner tube simultaneously brings about a rotational adjustment of the inner tube relative to the outer tube.

7. The reversing device according to claim 6, wherein the mechanical coupling element is guided in an elongated hole of the outer tube.

8. The reversing device according to claim 6, wherein the recesses are defined on two opposite sides of the outer tube and the recesses are defined on two sections of the inner tube offset relative to each other by an angle, wherein the angle by which the sections of the inner tube defining the recesses are offset corresponds to an angle by which the inner tube is rotationally adjustable relative to the outer tube during pivoting.

* * * * *